US005255476A

United States Patent [19]

Rutter

[11] Patent Number: 5,255,476

[45] Date of Patent: Oct. 26, 1993

[54] HONING MANDREL CONSTRUCTION

[75] Inventor: Harold T. Rutter, Kirkwood, Mo.

[73] Assignee: Sunnen Products Company, St. Louis, Mo.

[21] Appl. No.: 827,280

[22] Filed: Jan. 29, 1992

[51] Int. Cl.[5] ..... B24B 33/02; B24B 33/08

[52] U.S. Cl. ..... 51/355; 51/34 H; 51/338

[58] Field of Search ..... 51/330, 331, 338, 355, 51/345, 347, 348, 349, 34 H, 34 J, 34 K

[56] References Cited

U.S. PATENT DOCUMENTS

| | | | |
|---|---|---|---|
| 2,350,969 | 6/1944 | Sunnen | 51/338 |
| 2,376,851 | 5/1945 | Sunnen | 51/355 |
| 2,421,470 | 6/1947 | Sunnen | 51/338 |
| 2,532,682 | 12/1950 | Sunnen | 51/338 |
| 2,580,327 | 12/1951 | Sunnen | 51/338 |
| 2,815,615 | 12/1957 | Sunnen | 51/338 |
| 3,225,496 | 12/1965 | Sunnen | 51/355 |
| 4,212,136 | 7/1980 | Stertzbach | 51/331 |
| 4,249,348 | 2/1981 | Rutter | 51/338 |
| 4,254,591 | 3/1981 | Sedgwick et al. | 51/338 |
| 5,185,969 | 2/1993 | Vanderwal, Jr. | 51/338 |

*Primary Examiner*—Bruce M. Kisliuk
*Assistant Examiner*—Bryan Reichenbach
*Attorney, Agent, or Firm*—Haverstock, Garrett and Roberts

[57] ABSTRACT

A honing mandrel having an elongated body with a passageway extending along the length thereof including at least one open sided portion, the mandrel including an abrasive assembly positioned for radial movement in the open sided passageway portion having a radial outer surface formed of an abrasive material and a radial inner portion including spaced surfaces acutely angularly oriented relative to the axis of the mandrel body, cooperatively engageable surfaces on the abrasive assembly and on the body to prevent relative axial movement but not relative radial movement therebetween, and an operator member positioned in the passageway for axial movement therein, the operator member having surface portions thereon acutely angularly oriented relative to the axis of the mandrel body and positioned to make surface-to-surface slidable engagement with respective ones of the inner surfaces on the abrasive assembly whereby axial movements of the operator member in one direction relative to the abrasive assembly will produce radial movement of the abrasive assembly in an outward radial direction, the abrasive assembly and the operator member having adjacent side surfaces with other engaged portions including cooperatively engageable surfaces formed thereon which produce radial movement of the abrasive assembly in an inward direction when the operator member is moved in an axial direction opposite from the axial direction that produced the radial outward movement of the abrasive assembly.

21 Claims, 4 Drawing Sheets

HONING MANDREL CONSTRUCTION

BACKGROUND OF THE INVENTION

Honing mandrels including those that are expandable during honing have been in wide use for a considerable period of time. Such mandrels include open-sided elongated members, rotatable about their axes, with stone assemblies mounted in the open-side of the elongated member and movable radially therein by wedge members which have one or more tapered surfaces along one side which engage a corresponding number of tapered surfaces on the stone assemblies to advance the stone assemblies radially when the wedge moves axially to maintain the stone assemblies engaged, under load, with a work surface being honed. Mandrels of this general character have been in use for a long time. Typical of such mandrels are those shown in Sunnen U.S. Pat. Nos. 2,532,682, 2,580,327, and 3,225,496 and in copending application Ser. No. 07/811,816, filed Dec. 20, 1991 and assigned to Applicant's assignee.

One of the disadvantages or shortcomings of the known mandrel constructions is that the wedge members are usually relatively narrow steel blade-like members with narrow tapered ledges which engage correspondingly narrow beveled surfaces formed on one side of the stone assemblies. Movement of the wedge axially in one direction in the mandrel groove causes the ledges to slidably engage the beveled surfaces on the honing assembly to move the honing assembly radially outwardly. This is done under pressure during honing to maintain engagement between the honing assembly and a work surface. This construction works well and is satisfactory as long as the stone assemblies do not require that a great amount of force be applied to maintain them engaged with the work surface. Also in the known devices the wedge members are relatively loosely positioned in the mandrel groove and no means are provided to prevent the wedges or portions thereof from moving radially in the mandrel grooves. Maintaining the wedges bottomed in their grooves is preferred and is essential if the wedges are also to be used to retract as well as expand the honing diameter of such devices. Typical of the abrasive members or stones used on known honing mandrels are vitrified stones which do a good job of honing for most purposes but are not able to withstand the much greater honing pressures such as are used for honing with relatively harder materials without deteriorating or even crumbling. Also the time required to hone using vitrified abrasives is substantially longer than when honing with harder abrasives such as with superabrasives.

In order to make honing more efficient and faster, honing members or stones of much harder and more wear resistant materials are necessary. These include hones formed using materials that include particles of a substance such as diamond particles and particles of cubic boron nitride. Such materials are able to withstand considerably more honing pressure than vitrified abrasives and are able to hone many more surfaces before they show wear or wear out and need to be replaced or dressed. It has not been practical or economical in the past to mount abrasive members formed of such hard materials onto a conventional mandrel using conventional narrow steel wedge members because the known wedge members are not able to withstand higher honing pressures and Provide sufficient support to make it practical and advantageous to use the harder abrasives. Also, with the known mandrel constructions which for the most part are open-sided along substantially their entire lengths, the openness of the mandrels does not always provide sufficient support for the harder superabrasives without undergoing excessive stress which can cause the mandrels to distort and/or otherwise be damaged.

SUMMARY OF THE INVENTION

The present invention teaches the construction and operation of a novel mandrel construction which preferably uses a less than full length lateral opening or area along the mandrel for the abrasive assembly and the present device uses a wedge assembly which provides a much greater area of support and better support and force distribution for the abrasive assemblies during honing. The present construction can also incorporate an operator or adjustable wedge member or assembly formed of a less expensive material such as of a cast metal material. Furthermore, the operator wedge member or assembly in the present construction not only provides more and better support for the abrasive during honing but it also provides means for positively radially retracting the stone assemblies so that the stone assemblies can be moved out of engagement with the work surface in a positive manner and without permitting any radial movement of the wedge. To this end the present mandrel construction has a body Portion which is tubular over a substantial portion of its length to contain the wedge member and add greater strength and less possibility for stress damage or deflection due to the presence of greater torsional or twisting forces produced by using harder abrasives. The present device includes means to maintain the wedge assembly bottomed in the mandrel groove and prevents it from rising or moving radially even when retracting the abrasive assembly. The present mandrel construction is especially adaptable for use with superabrasives and can be used with other softer and intermediate grade abrasives as well, and can be constructed to be used on known and existing honing machines. This means that the present mandrel construction, being able to use harder abrasives including suberabrasives, will be able to hone at a faster rate and with greater accuracy, with minimal wear and tear on the abrasive thereby increasing the rate of honing and stock removal and without requiring as much maintenance and parts replacement as has been the case in the past. There will also be less wear on the wider wedge support surfaces. Also, the present construction can be operated using automatic feed means for much longer periods of time with little or no operator attention.

OBJECTS OF THE INVENTION

A principal object of the present invention to provide an improved honing mandrel construction that can be used on existing honing machines and can be used with superabrasives.

Another object is to reduce the downtime and maintenance required for a honing machine and particularly for the mandrels used thereon.

Another object is to reduce the honing time and improve the accuracy of devices that are honed.

Another object is to enable the honing of many more parts by a honing mandrel that uses a die cast stone support and wedge in a continuous process and to some desired dimension and accuracy.

Another object is to teach the construction of a honing mandrel that is able to withstand greater honing pressures.

Another object is to substantially increase the honing efficiency of honing mandrels.

Another object is to teach the construction of a honing mandrel that includes means for positively radially advancing as well as positively radially retracting the work engaging honing assemblies.

Another object is to strengthen a mandrel and make it less susceptible to damage due to overloading.

Another object is to provide means to prevent radial movements of the stone advancing means in a honing mandrel.

These and other objects and advantages of the present invention will become apparent after considering the following detailed specification covering preferred embodiments thereof in conjunction with the accompanying drawings.

DETAILED DESCRIPTION OF PREFERRED EMBODIMENTS

Figures 1, 2, 3, 4, 5, 6, 7:
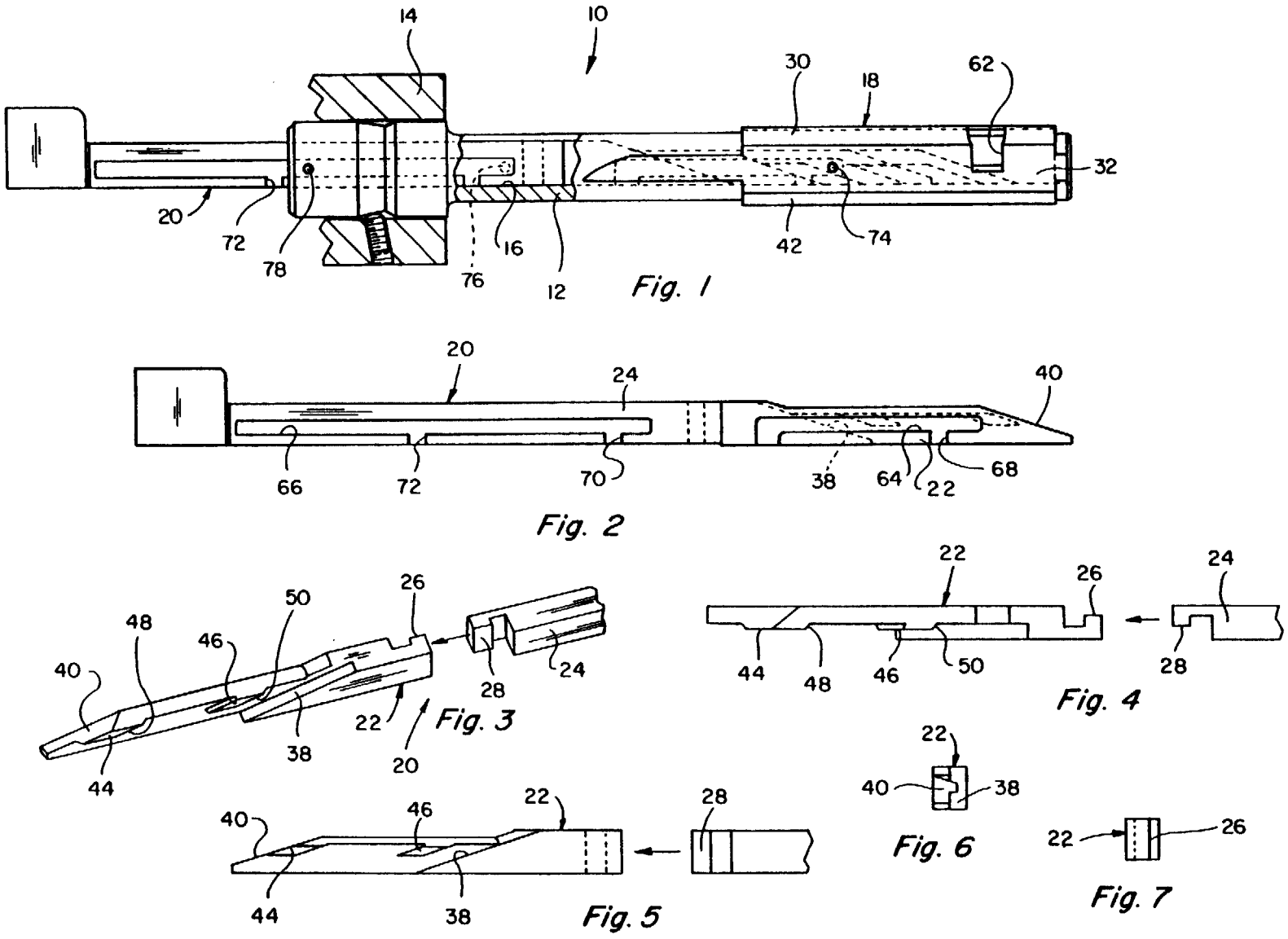
FIG. 1 is a side elevational view, partly in cross-section, of a honing mandrel constructed according to the present invention.
FIG. 2 is a side elevational view of the wedge assembly for the mandrel of FIG. 1.
FIG. 3 is a top perspective view in exploded form of the wedge assembly of FIG. 2.
FIG. 4 is a fragmentary top view in exploded form of the wedge assembly of FIG. 2.
FIG. 5 is a side elevational view of the wedge assembly of FIG. 4.
FIG. 6 is a left end view of the wedge assembly of FIG. 5.
FIG. 7 is a right end view of the wedge assembly of FIG. 5.
Figure 11:
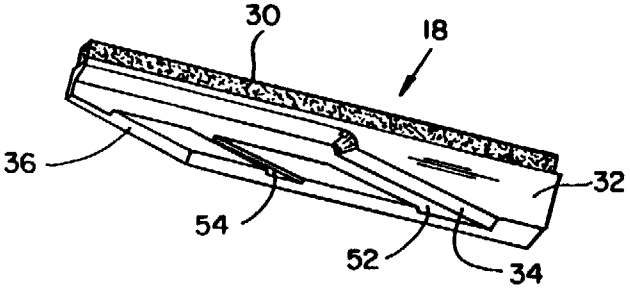
FIG. 11 is a bottom perspective view of the abrasive assembly of FIG. 8.
Figure 8:
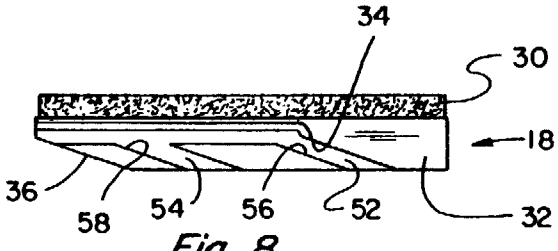
FIG. 8 is a side elevational view of an abrasive assembly for use in the mandrel of FIG. 1.
Figure 9:
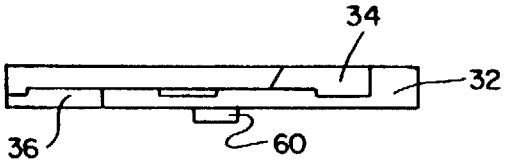
FIG. 9 is a bottom view of the abrasive assembly of FIG. 8.
Figure 10:
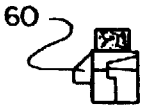
FIG. 10 is a left end view of the abrasive assembly of FIG. 8.
Figure 12:
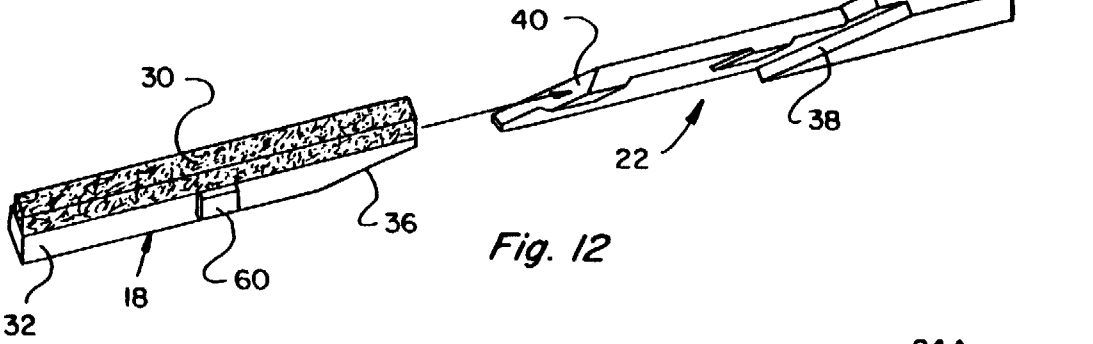
FIG. 12 is a top perspective exploded view of the wedge assembly in alignment with the abrasive assembly.

Referring to the drawings more particularly by reference numbers, number 10 in FIG. 1 refers to a honing mandrel constructed according to the present invention. The mandrel 10 includes an elongated body member 12 which in shown having one end mounted in an adapter 14 for installing the mandrel on a honing machine or like device. The body 12 has an elongated open sided passageway or channel 16 extending from end to end. The passageway 16 accommodates an abrasive assembly 18 and a wedge assembly 20. The wedge assembly 20 includes a wedge portion 22 and a connected portion 24 (FIG. 2) which are coupled together for axial movement in concert by engaged tongues 26 and 28 (FIG. 4 and 5). The construction, interaction and operation of the stone assembly 18 and the wedge assembly 20 are important to the invention.

The abrasive or stone assembly 18 and the wedge assembly 20 are mounted in the body passageway 16 and together extend along substantially the length thereof. The assembly 18 includes an outer abrasive member or stone 30 and an internal backing portion 32 which is preferably formed of metal such as diecast zinc alloy or other like metal. The wedge portion 22 of the wedge assembly 20 in the embodiment shown in FIG. 1 slidably engages the stone assembly 18 when the wedge assembly is moved axially in the mandrel passageway 16 causing the assembly 20 to move radially inwardly or outwardly in the passageway 16 depending on the direction of movement of the wedge assembly 20 as will be explained. The rear connected portion 24 of the wedge assembly 20 extends through and from the passageway 16 in the mandrel body 12 and is operatively connected to means in the honing machine which move the member 24 and the coupled wedge member 22 axially in the passageway 16. These axial movements are under control of the means in the honing machine which are not part of the present invention.

One construction of the wedge assembly 20 including the coupled portions 22 and 24 thereof is shown more in detail in FIGS. 2-7. FIG. 3 is a top perspective view of the assembly 20 showing the wedge portion 22 having the tongue portion 26 formed on the rear end and cooperatively engaged with the similarly shaped tongue portion 28 on one end of the member 24. When the member 24 is moved axially in the passageway 16 under control of means in the honing machine, the members 22 and 24 move axially in concert.

The backing portion 32 of the abrasive assembly 18 (FIG. 8) is constructed to have surfaces 34 and 36 formed thereon which surfaces are acutely angularly oriented relative to the axis of the mandrel, which surfaces cooperatively engage similar angularly oriented beveled surfaces 38 and 40 on the wedge assembly 20 (FIGS. 2-5) In the construction shown in FIGS. 1-12, the overall cross-sectional size and shape of the engaged wedge and stone assemblies 18 and 20 correspond over most of their lengths to the cross-sectional size and shape of the passageway 16 in the mandrel body 12. This is done to prevent angular, lateral and transverse movements of these assemblies in the mandrel body 12 during axial movements of the wedge assembly 20 and to provide better support for the abrasive assembly 18. It is to be understood, however, that the stone assembly 18 must extend from the open side of the mandrel passageway 16 for engaging the work, and the opposite side of the mandrel will have surfaces adjacent thereto, sometimes called shoes 42, that also engage the work surface and provide backing support for the abrasive assembly 18.

Referring again to FIGS. 2–5, one side of the wedge assembly 20 has one or more sidewardly extending projecting portions 44 and 46 which are shaped to have at least one side edge thereof, such as the side edges 48 and 50, formed at an acute angle relative to the axis of the mandrel. The portions 44 and 46 extend into recessed regions 52 and 54 respectively (FIGS. 8 and 11) in the backing Portion 32 of the stone assembly 18, and the angled surfaces or edges 48 and 50 of the portions 44 and 46 engage edges 56 and 58 (FIG. 8) of the stone assembly 18 and cooperate to provide means for positively retracting the stone assembly 18 during operation of the mandrel. Thus it can be seen that the surfaces 38 and 40 on the wedge assembly 20 engage the surfaces 34 and 36 on the stone assembly 18 to move the stone assembly 18 radially outwardly when the wedge 20 is moved in a first or forward axial direction and Provide support therefor. The area of engagement between these surfaces is substantial and makes it possible to apply considerable outward pressure on the honing assembly during a honing operation. The edges 48 and 50 of the portions 44 and 46 on the other hand cooperate with the edges 56 and 58 on the stone assembly 18 to draw the stone assembly 18 radially inwardly when the wedge assembly 20 is moving in the opposite or rearward direction. The mating surfaces 34, 36, 38 and 40 as aforesaid are all made to be relatively wide in the present construction adding stability and providing better support for the honing assembly 18 than prior art narrow wedge constructions, and they enable the assembly 18 to be efficiently and effectively used to hone even with superabrasives. The combined width of these mating surfaces on the assemblies can be made to equal or in some cases to exceed the width of the stone assembly 18 at their places of contact. This provides added support for the stone assemblies.

The stone assembly 18 also has a sidewardly projecting portion 60 (FIGS. 9 and 10) which cooperates with a cut-out 62 (as shown in FIG. 1 for example) formed in the mandrel body 12 adjacent one side of the passageway 16. Cooperation between the projection 60 and the cut-out 62 operates to limit or prevent axial movement of the stone assembly 18 during radial movement thereof when the wedge assembly 20 is moving axially. The projection 60 is shown located on the opposite side of the honing assembly 18 from the side that has the recessed regions 52 and 54 but this is not necessary in all cases. In FIGS. 8–11 the stone assembly 18 is shown having the stone or abrasive portion 30 located extending along the side that engages the work, and it is contemplated to use a vitrified stone as well as a stone or abrasive member formed of a harder material such as a superabrasive material which are materials that include particles of diamond or cubic boron nitride with a binder. Superabrasive members can be relatively thin in the radial direction compared to vitrified abrasives, they last much longer than vitrified abrasives, and they are able to withstand much higher honing pressures and therefore can hone faster.

Referring again to FIGS. 1 and 2, the wedge assembly 20 including the portions 22 and 24, each have axially extending grooves 64 and 66 extending along most of the length thereof on one side. The grooves 64 and 66 communicate with radially extending groove portions or openings 68, 70 and 72 which extend to the bottom of the wedge members as best shown in FIG. 2. The open sided passageway 16 extends the length of the mandrel body 12. The openings 68, 70 and 72 are located to be alignable with respective pins 74, 76 and 78 located extending sidewardly from one side wall of the passageway 16 in the mandrel body 12. When the respective portions 22 and 24 of the wedge assembly are located adjacent the open side of the passageway 16. The pins 74, 76 and 78 are positioned to be able to move through the respective openings 68, 70 and 72 and into the grooves 64 and 66 when the wedge assembly 20 is inserted into the passageway 16 through the open side thereof. When the wedge assembly is located in the passageway 16 and the pins 74, 76, and 78 are located in the grooves 64 and 66, the wedge assembly 20 can move longitudinally or axially in the passageway 16 but without being able to move radially outwardly in the Passageway 16, and this is true over the range of movement necessary to apply force to the stone assembly 18. These pins and grooves therefore cooperate to keep the wedge assembly 20 including the portions 22 and 24 bottomed in the passageway 16. This is an important advantage since the engagement between the wedge and the stone assemblies 18 and 20 is such that they remain engaged with one another in all operative positions thereof.

If the wedge assembly is constructed to substantially fill the lateral space in the passageway 16 then it is also possible to stake or bend over portions of the upper edges of the passageway 16 to prevent the wedge 20 from moving radially in the passage. If staking or some other passage closing means are used it is not necessary to provide pins and grooves such as the pins 74, 76 and 78 and the grooves 64 and 66 to hold the wedge assembly 20 bottomed in the passageway 16.

Figure 13:
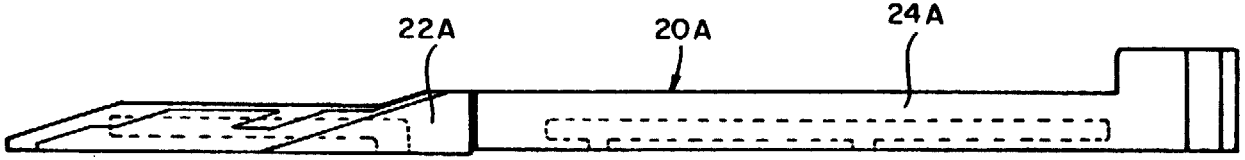
FIG. 13 is a side elevational view of one piece embodiment of the wedge assembly for use in the mandrel of FIG. 1.
Figure 14:
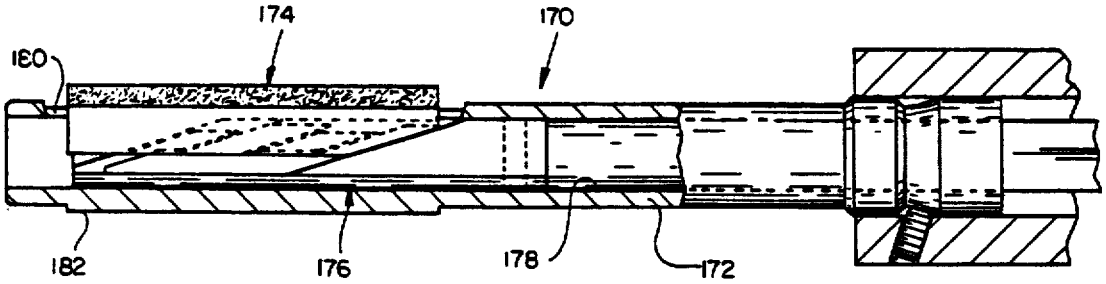
FIG. 14 is a side elevational view partly in cross-section of a tubular embodiment of a mandrel constructed according to the present invention.
Figure 18:
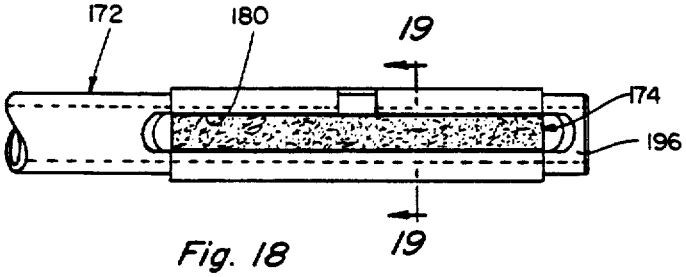
FIG. 18 is a fragmentary top plan view of the mandrel of FIGS. 14.
Figure 17:
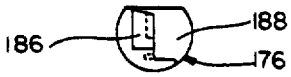
FIG. 17 is a left end view of the wedge assembly of FIG. 16.

FIG. 13 shows a one piece form of wedge assembly 20A which is similar in construction to the wedge assembly 20 except for being of one piece. The wedge 20A has features similar to those described above for the wedge assembly 20 including the fact that the forward end portion 22A is shown made as wide as the passageway 16 in which it is positioned in order to provide the maximum amount of support for the stone assembly 18. The rearward portion 24A of the one piece wedge assembly 20A is shown somewhat narrower than the passageway 16 and this may provide an advantage of enabling means to be positioned along one side of the wedge 20A to bias the wedge assembly into an extended position in the passageway 16 so as to maintain the wedge assembly 20A engaged under some pressure with the stone assembly 18 at all times. Such biasing means may be similar to the member 174 and the biasing means associated therewith as shown in Sunnen Patent No. 4,249,348.

Figure 19:
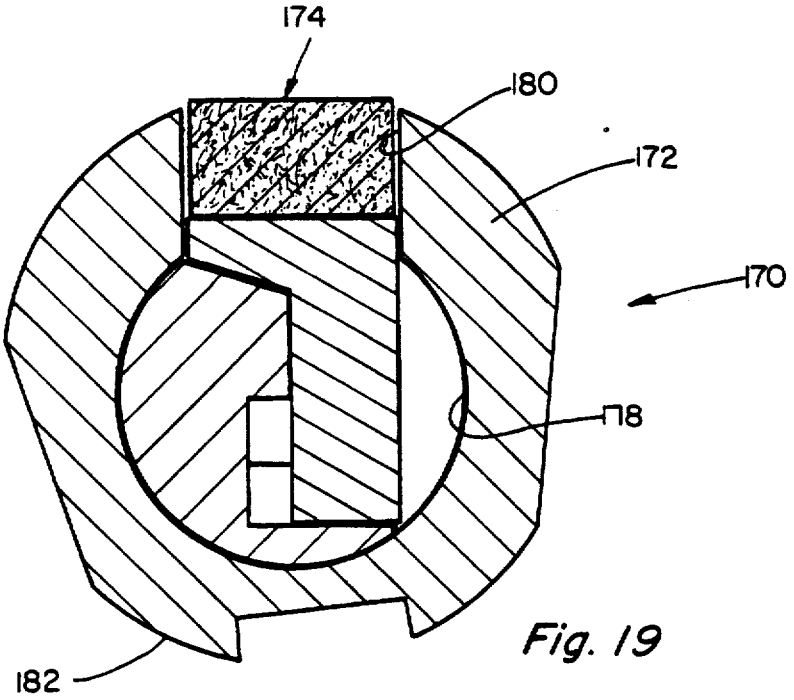
FIG. 19 is an enlarged cross-sectional view of the mandrel of FIG. 18 taken along line 19—19.

FIGS. 14–21 show another embodiment 170 of the subject mandrel wherein the mandrel has a tubular body 172 over most of its length with a stone assembly 174 and a wedge assembly 176 operably positioned therein. The mandrel body 172 has a cylindrical bore 178 therethrough that receives the cooperatively engaged stone assembly 174 and wedge assembly 176. The cross-sectional size and shape of the wedge assembly 176 including where it engages the stone assembly 174 closely corresponds to the cylindrical cross-sectional size and shape of the cylindrical bore 178 so that there is always substantial support and backing for the stone assembly 174. In the construction 170 the stone assembly moves radially in a body opening 180 formed in one side of the body 172. The opposite side of the body 172 from the opening 180 is provided with two outwardly extending work engaging shoe portions 182, the center line of which as shown in FIG. 19 is oriented at an angle of approximately 7° from being diametrically opposite from the opening 180. The shoe portions 182 bear against a work surface being honed substantially opposite from the stone assembly 174 and provide backing support therefor. The offsetting of the stones relative to the stone assembly is done to reduce or prevent vibration or chattering and to improve the operation of the mandrel, well known to such constructions.

Figure 15:
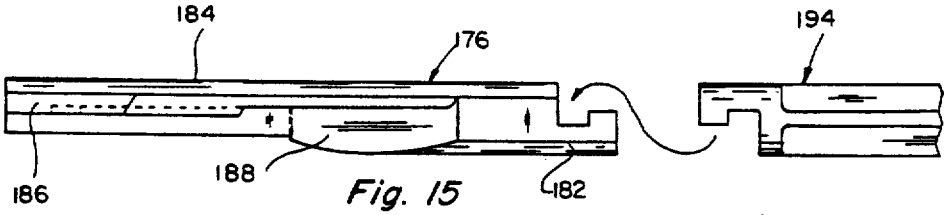
FIG. 15 is a top view of a wedge assembly for use in the tubular mandrel of FIG. 14.
Figure 16:
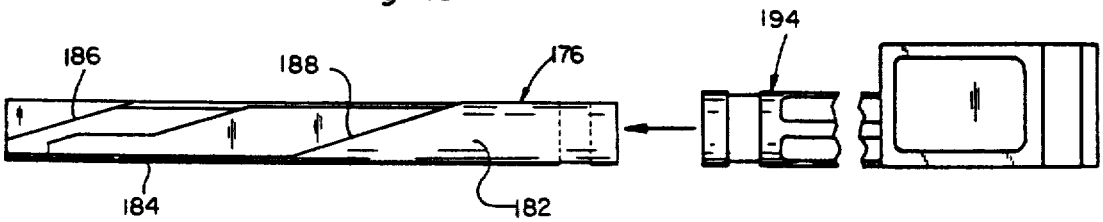
FIG. 16 is a side elevational view of the wedge assembly of FIG. 15.
Figure 20:
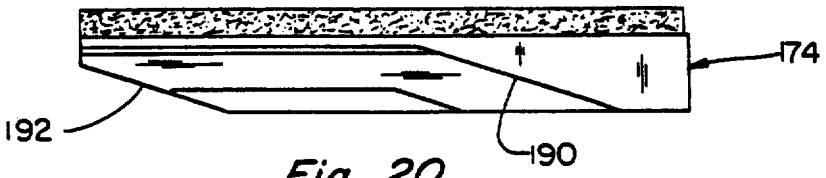
FIG. 20 is a side elevational view of another form of honing assembly for use in the mandrel of FIG. 14.
Figure 21:
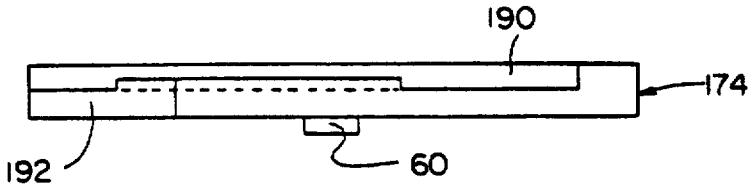
FIG. 21 is a bottom view of the honing assembly of FIG. 20.

In FIGS. 15 and 16 the wedge assembly 176 is shown rounded as at 182 and 184 to conform over much of the surface thereof to the shape of the body bore 178. The wedge assembly 176 also has cam or beveled surfaces 186 and 188 which engage similarly oriented surfaces 190 and 192 (FIGS. 20 and 21) on the stone assembly 174 in a manner similar to that described above in connection with the mandrel 10. The wedge assembly 176 is also shown as being of two piece construction as in the construction shown in FIGS. 2-5 including having similar tongue-like coupling means between the separate portions 176 and 194. In this case both coupled portions have rounded or cylindrical portions sized and shaped to make sliding engagement with the cylindrical mandrel passageway 178. The connecting or operating member 194 is shown having a crossed shaped cross-section over most of its length to reduce the amount of material needed in its construction without reducing its strength. The main difference between the construction shown in FIGS. 14-21 and the construction 10 is that the wedge and stone assemblies 174 and 176 conform or nearly conform over much of their lengths, and especially where the cam surfaces 186 and 188 are located, to the shape of the mandrel passageway or bore 178 thereby providing good support for the hone assembly 174 over the length thereof. Another difference between the constructions 170 and 10 is that the sidewardly open passageway 16 extends along the entire length of the mandrel body 12 of the construction 10, while on the other hand, the construction 170 has or may have a mandrel bridging connection or portion 196 (FIG. 18) that extends across and bridges the tubular mandrel adjacent to the free end thereof which is at the end of the opening 180 provided for the stone assembly 174. This further strengthens the mandrel body 172 and further reduces the chance for mandrel damage due to excessive strains particularly when honing at high honing pressures and with abrasives such as with superabrasives. However, the stone assembly 174 must be able to move radially in the body opening 180 and cannot exceed the length or width of the opening 180.

The present mandrel constructions represent important improvements over known mandrels used for the same or similar Purposes. These improvements include providing better support for the stone assemblies so that harder abrasive materials can be used in the honing process, the present mandrel can be used on existing honing machines as well as on improved honing machines, the present mandrels have the ability to operate at and produce greater honing pressures without damage, the subject mandrels are less likely to be overloaded and damaged due to twisting forces, the ability to use harder abrasives materials that are less subject to wear means that the subject mandrels can be used with honing devices that have automatic feed means so that many more parts can be honed with the same stone, and the subject devices can use harder stones as well as harder shoes and each of the subject mandrels can hone a great many parts to a precise diameter without requiring substantial maintenance or adjustment by the operator. Thus the present device relieves the operator of many of his duties while at the same time improving the results that are obtained and doing so in a repetitious fashion thereby making the honing of parts more efficient and less labor intensive. Still further, the present mandrel is constructed to maintain the wedge assembly bottomed in the mandrel passageway so that it can not rise up and produce inaccuracies or permit the stone assembly to fly out due to centrifugal or other forces, and the present construction permits the honing machine to be programmed or controlled to expand the honing diameter as required and also enables the stone assembly to be retracted out of engagement with the work so that the work can be easily removed from and replaced on the mandrel without danger and without interference or dragging of the work piece along the mandrel during installment and removal.

Thus there has been shown and described a novel mandrel construction which fulfills all of the objects and advantages sought therefor. It will be apparent to those skilled in the art, however, that many changes, modifications, variations and other uses and applications for the subject mandrel are possible. All such changes, modifications, variations and other uses and applications which do not depart from the spirit and scope of the invention are deemed to be covered by the invention which is limited only by the claims which follow.

What is claimed is:

1. A honing mandrel comprising an elongated mandrel body having a central longitudinal axis, a passageway extending along at least a portion of the length of said mandrel body and a radial opening communicating with said passageway along at least a portion of the length thereof, an abrasive assembly positioned in the radial opening for movement in a radial direction, said abrasive assembly having a radial outermost surface formed of an abrasive material and axially spaced inner surface portions located radially inwardly of said outermost surface and acutely angularly oriented relative to the axis of the mandrel body, each of said inner surface portions having a width measured in a direction perpendicular to said radial direction and said longitudinal axis, wherein the sum of the widths of said inner surface portions is at least equal to the width of the abrasive assembly means on the abrasive assembly cooperatively engageable with means on the mandrel body to prevent relative axial movement therebetween, an operator member formed of cast metal positioned for axial movement in the passageway of said mandrel body, said operator member having axially speed surface portions thereon acutely angularly oriented relative to the axis of the mandrel body and positioned to make slidable engagement with the respective inner surface portions on the abrasive assembly whereby axial movement of the operator member in one direction relative to the abrasive assembly will produce radial movement of the abrasive assembly in an outward radial direction, and means on said operator member cooperatively engageable with means on said abrasive assembly for producing radial movement of the abrasive assembly in an inward radial direction when the operator member is moved in an axial direction opposite from said one axial direction relative to the abrasive assembly.

2. The honing mandrel of claim 1 wherein the radial outermost surface of the abrasive assembly is formed of a superabrasive material and the abrasive assembly further includes a radially inwardly backing portion formed of cast metal material.

3. The honing mandrel of claim 1 wherein the operator member includes a first operator portion having the axially spaced surface portions thereon and a second operator portion coupled to the first operator portion and extending axially therefrom through the passageway.

4. The honing mandrel of claim 1 wherein the cooperatively engageable means on the operator member and on the abrasive assembly include at least one portion on the operator member extending sidewardly relative to the axis of the mandrel body and having an acutely angularly oriented edge relative to the axis of the mandrel body formed thereon and said abrasive assembly has a groove formed therein for receiving said sidewardly extending portion on the operator member, said groove having a surface thereon acutely angularly oriented relative to the axis of the mandrel body and slidably engageable by the sidewardly extending portion on the operator member to positively retract the abrasive assembly into the radial opening when the operator member is moved in said opposite axial direction relative to the abrasive assembly.

5. The honing mandrel of claim 1 further comprising means on the mandrel body cooperatively engageable with means on the operator member for enabling axial movement of the operator member in the passageway but not radial movement therein.

6. The honing mandrel of claim 5 wherein the means on the mandrel body include at least one portion extending sidewardly relative to the axis of the mandrel body adjacent the passageway, which sidewardly extending portion cooperatively engages the operator member to prevent radial movement thereof in the passageway.

7. A honing mandrel comprising an elongated mandrel body having a central longitudinal axis extending between opposite ends thereof, a passage extending through the mandrel body between the opposite ends and a radial opening communicating with the passage at an intermediate location along the length thereof, an abrasive assembly positioned in the radial opening for movement in a radial direction, said abrasive assembly having a radial outermost surface formed of an abrasive material and a radial inner portion having axial spaced inner surfaces formed thereon, each of said inner surfaces being oriented at an acute angular orientation relative to the axis of the mandrel body and having a width measured in a direction perpendicular to said radial direction and said longitudinal axis, wherein the sum of the widths of said inner surfaces is at least equal to the width of the abrasive assembly, cooperatively engageable means on the abrasive assembly and on the mandrel body to prevent relative axial movement therebetween, an operator member formed of cast metal positioned in the passage extending through the mandrel body for axial movement therein, said operator member having axially spaced wedge surface portions thereon acutely angularly oriented relative to the axis of the mandrel body to be in surface-to-surface engagement respectively with the acutely angularly oriented inner surfaces on the abrasive assembly whereby axial movements of the operator member in one direction in the passage produces outward radial movement of the abrasive assembly in the radial opening, each of said wedge surface portions having a width corresponding approximately to the width of the respective inner surface portion in surface-to-surface engagement therewith, and other cooperatively engageable means on the abrasive assembly and on the operator member for moving the abrasive assembly radially inwardly in the radial opening when the operator member is moved axially in the passage in a direction opposite from said one direction.

8. The honing mandrel of claim 7 wherein the spaced surface portions formed on the inner surface of the abrasive assembly are located respectively adjacent opposite ends of the abrasive.

9. The honing mandrel of claim 7 wherein the cross-sectional size and shape of at least a portion of the operator member corresponds to the cross-sectional size and shape of the passage in the mandrel body.

10. The honing mandrel of claim 7 wherein the other cooperatively engageable means on the abrasive assembly and on the operator member include at least one portion extending sidewardly relative to the axis of the mandrel body on the operator member, said sidewardly extending portion having an edge portion acutely angularly oriented relative to the axis of the mandrel, and a groove formed in the abrasive assembly for receiving said sidewardly extending portion of the operator member, said groove having an edge surface thereon slidably engageable by the sidewardly extending portion of the operator member for positively retracting the abrasive assembly into the radial opening when the operator member is moved in said direction opposite from said one direction.

11. The honing mandrel of claim 7 further comprising means on the mandrel body cooperatively engageable with means on the operator member to permit relative axial but not relative radial movement therebetween.

12. In a honing mandrel having an elongated member with a passageway extending along the length thereof, the elongated member being mountable for rotation about a central longitudinal axis thereof, a stone assembly positioned in the passageway and having axially spaced radially inwardly facing surface portions acutely angularly oriented relative to the axis of the mandrel, and adjustment means including a wedge member formed of cast metal positioned in the passageway, the stone assembly and the wedge member having adjacent side surfaces and the wedge member having a pair of axially spaced radially outwardly facing surfaces thereon acutely angularly oriented relative to the axis of rotation of the elongated member, the angularly oriented surfaces on the adjustment member and on the stone assembly being in surface-to-surface engagement such that axial movements of the wedge member in one direction in the passageway produces radial movement of the stone assembly in a radial outward direction, the improvement comprising the spaced radially inwardly facing surface portions of the stone assembly each having a width measured in a direction perpendicular to said radial direction and said longitudinal axis, wherein the sum of the widths of said inwardly facing surface portions is at least equal to the width of the stone assembly, and cooperatively engageable means on the adjacent side surfaces of the stone assembly and of the wedge member for positively radially retracting the stone assembly into the passageway in the elongated member when the wedge member is moved in a retracting direction which is opposite to the one direction in the passageway.

13. In the honing mandrel of claim 12 the cooperatively engageable means include a projecting member on the adjacent side of the stone assembly extending sidewardly relative to the axis of the elongated member and a groove on the adjacent side of the wedge member for receiving said sidewardly projecting member.

14. In the honing mandrel of claim 12 the cooperatively engageable means include a projecting portion on the wedge member extending sidewardly relative to the axis of the elongated member and a groove on the adjacent side of the stone assembly for receiving said sidewardly projecting portion.

15. In the honing mandrel of claim 12 the further improvement of having the elongated member tubular along at least a portion of the length thereof.

16. In the honing mandrel of claim 12 the cross-sectional size and shape of the wedge member correspond to the cross-sectional size and shape of the passageway in the elongated member over at least a portion of the length thereof.

17. A honing mandrel comprising an elongated mandrel body having a central longitudinal axis of rotation, a passageway extending along the length of the mandrel body, said passageway having sides extending the length thereof and being open along one side thereof over the length of the mandrel body, an abrasive assembly positioned in the passageway, said abrasive assembly and said body having cooperatively engageable means to enable relative radial but not relative axial movement therebetween, said abrasive assembly having a radially outermost abrasive surface and axially spaced inner surfaces located radially inwardly of the outermost abrasive surface and acutely angularly oriented relative to the axis of the mandrel body, each of said inner surfaces having a width measured in a direction perpendicular to said radial direction and said longitudinal axis, wherein the sum of the widths of said inner surfaces is at least equal to the width of the abrasive assembly, an operator member formed of cast metal positioned in the passageway for axial movement therein, the cross-sectional size and shape of the abrasive assembly and of the operator member corresponding to the cross-sectional size and shape of the passageway along a portion of the length thereof, said operator member having axially spaced surface portions thereon acutely angularly oriented relative to the axis of the mandrel body in position to make slidable engagement with the respective inner surfaces on the abrasive assembly whereby axial movement of the operator member in one direction relative to the abrasive assembly will produce radial movement of the abrasive assembly in and outward radial direction, each of said axial spaced surface portions on the operator member having a width measured in a direction perpendicular to said radial direction and said longitudinal axis, wherein the sum of the widths of said axial spaced surface portions is at least equal to the width of the abrasive assembly, cooperatively engageable means on the mandrel body and on the operator member to permit relative axial but not relative radial movement therebetween including means on the mandrel body extending sidewardly in the passageway relative to the axis thereof and groove means on the operator member engageable with the sidewardly extending means in the passageway, and other cooperatively engageable means on the abrasive assembly and on said operator member capable of producing radial movement of the abrasive assembly in an inward radial direction when the operator member is moved in an axial direction opposite from said one axial direction relative to the abrasive assembly.

18. A honing mandrel of claim 17 wherein the abrasive assembly includes a backing portion formed of a molded metal material.

19. A honing mandrel comprising an elongated mandrel body having a central longitudinal axis of rotation and a passageway extending along the length thereof, an opening in one side of said mandrel body extending radially into the passageway, an abrasive assembly positioned in the opening for movement in a radial direction, the abrasive assembly having a radially outermost abrasive surface and inner surfaces located radially inwardly of said abrasive surface and acutely angularly oriented relative to the central longitudinal axis, each of said inner surfaces having a width measured in a direction perpendicular to said radial direction and said longitudinal axis, wherein the sum of the widths of said inner surfaces is at least equal to the width of the abrasive assembly, cooperatively engageable means on the mandrel body and on the abrasive assembly to enable relative radial but not relative axial moment therebetween, an operator member formed of cast metal positioned in the passageway for axial movement therein, said operator member having a cross-sectional shape and size over a portion of the length thereof that substantially conforms to the cross-sectional shape and size of the passageway in the body, said operator member having axially spaced surface portions acutely angularly oriented relative to the axis of the mandrel body in position to make slidable engagement with respective inner surfaces on the abrasive assembly, each of said surface portions having a width measured in a direction perpendicular to said radial direction and said longitudinal axis, wherein the sum of the widths of said surface portions is substantially equal to the width of the abrasive assembly, axial movement of the operator member in one direction relative to the abrasive assembly producing radial movement of the abrasive assembly in a radial outward direction, and cooperatively engageable means on the abrasive assembly and on the operator member capable of producing radial movement of the abrasive assembly in an inward radial direction when the operator member is moved in an axial direction opposite from said one axial direction relative to the abrasive assembly.

20. The honing mandrel of claim 19 wherein the abrasive assembly includes a radial outward portion formed of an abrasive material and a backing portion formed of a diecast metal.

21. The honing mandrel of claim 19 wherein the combined widths of the acutely angularly oriented surfaces on the abrasive assembly and on the operator member at lest equal the width of the abrasive assembly.

* * * * *

UNITED STATES PATENT AND TRADEMARK OFFICE

CERTIFICATE OF CORRECTION

PATENT NO. : 5,255,476

DATED : October 26, 1993

INVENTOR(S) : HAROLD T. RUTTER

It is certified that error appears in the above-indentified patent and that said Letters Patent is hereby corrected as shown below:

Column 1, line 67, "Provide" should be --provide--.
Column 2, line 28, "Portion" should be --portion--.
Column 4, line 57, after "(Figs. 2-5)" insert --.--.
Column 5, line 12, "Portion" should be --portion--.
line 21, "Provide" should be --provide--.

Column 6, lines 18-19, "Passageway" should be --passageway--.
Column 7, line 56, "Purposes" should be --purposes--.
Column 8, line 51, after "assembly" insert --,--.
line 58, "speed" should be --spaced--.
Column 11, line 62, "and" should be --an--.
Column 12, line 34, "moment" should be --movement--.

Signed and Sealed this

Twenty-ninth Day of March, 1994

Bruce Lehman

*Attest:*

BRUCE LEHMAN

*Attesting Officer*

*Commissioner of Patents and Trademarks*